United States Patent [19]

Quinn, Jr.

[11] Patent Number: 4,579,162

[45] Date of Patent: Apr. 1, 1986

[54] PERMANENT BACKUP MOLDING PROCESS

[76] Inventor: Thomas S. Quinn, Jr., Rolling Meadows, Cornwall, Pa. 17016

[21] Appl. No.: 331,156

[22] Filed: Dec. 16, 1981

Related U.S. Application Data

[63] Continuation of Ser. No. 180,226, Aug. 21, 1980, abandoned, which is a continuation of Ser. No. 21,478, Mar. 19, 1979, abandoned, which is a continuation of Ser. No. 885,316, Mar. 10, 1978, abandoned.

[51] Int. Cl.[4] ..... B22C 9/12; B22C 15/22

[52] U.S. Cl. ..... 164/16; 164/21

[58] Field of Search ..... 164/12, 16, 21, 22

[56] References Cited

U.S. PATENT DOCUMENTS

| | | | |
|---|---|---|---|
| 1,650,260 | 11/1927 | Candler | 164/348 X |
| 2,049,967 | 8/1936 | Lutton | 164/326 X |
| 2,476,219 | 7/1949 | Purington | 164/327 X |
| 2,720,687 | 10/1955 | Shaw | 164/21 |
| 3,077,014 | 2/1963 | Jennings et al. | 164/21 |

FOREIGN PATENT DOCUMENTS

| | | | |
|---|---|---|---|
| 51-16018 | 5/1976 | Japan | 164/352 |

*Primary Examiner*—Kuang Y. Lin

*Attorney, Agent, or Firm*—Austin R. Miller

[57] ABSTRACT

A process for casting metals is disclosed wherein a thin refractory lining is formed between a pattern half and a permanent backup plate. For each desired casting, two mating backup plates are provided; each having portions corresponding roughly to the desired configuration of the casting. A pattern half is aligned against each backup plate so that a thin space along the plate - pattern interface is formed. A bondable refractory material is blown into this space and caused to set by heating or the addition of reactants or catalysts thereto. Each pattern half is then removed from the backup plate assembly and the lined, mating backup plates are assembled together so as to form a lined mold cavity therebetween. The desired molten metal is then poured into the cavity. After the casting is cooled, the refractory is stripped from the backup plates and the backup plates are recycled for further use.

16 Claims, 7 Drawing Figures

FIG. 3
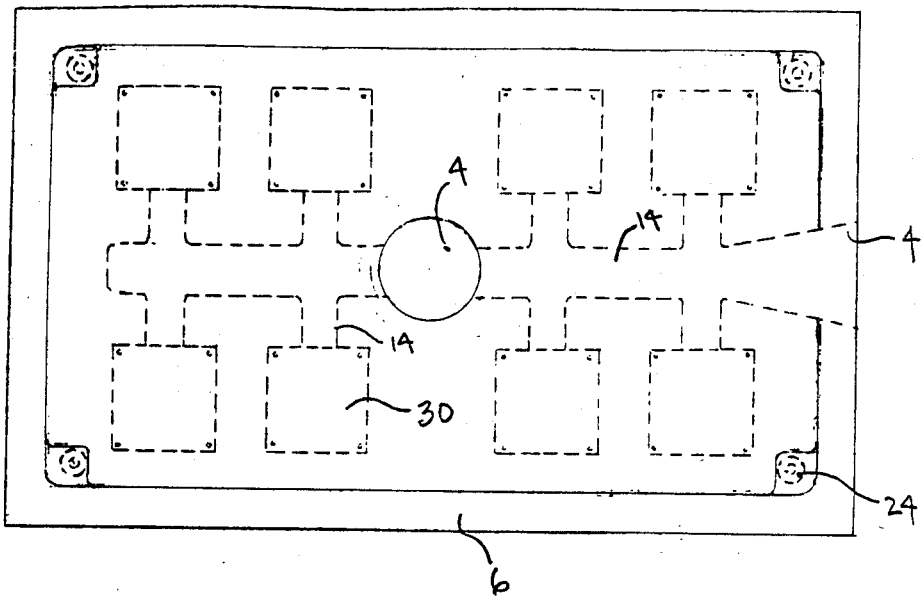
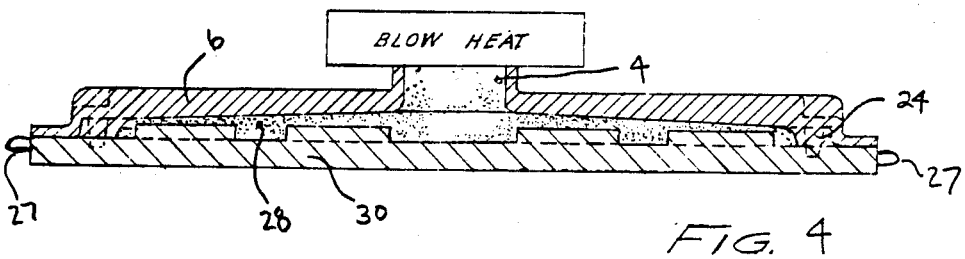
FIG. 4
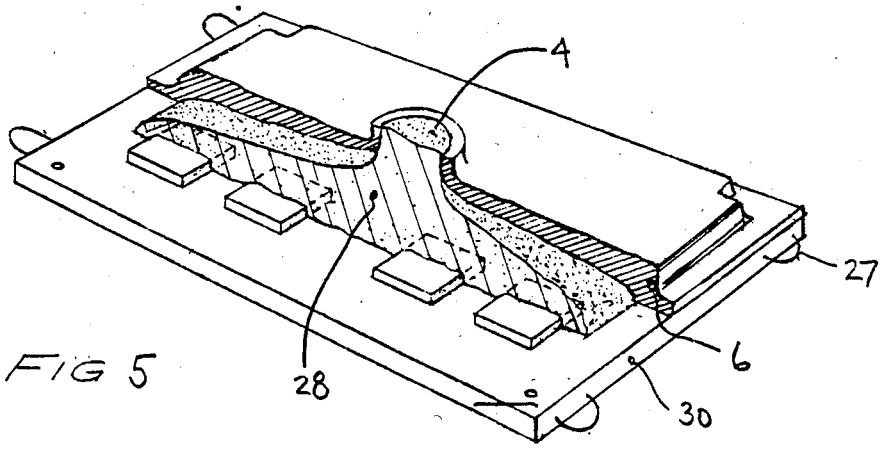
FIG 5

PERMANENT BACKUP MOLDING PROCESS

This is a continuation application of application Ser. No. 180,226 filed Aug. 21, 1980 which in turn is a continuation of application Ser. No. 021,478 filed Mar. 19, 1979 which in turn is a continuation of application Ser. No. 885,316 filed Mar. 10, 1978, all are abandoned.

BACKGROUND OF THE INVENTION

1. Field of the Invention

The present application discloses a process for casting dimensionally accurate reproductions of a pattern wherein a minimum amount of sand is used. The disclosed process may be effectively implemented in a continuous operation wherein all components of the mold assembly are manually or automatically transported to the various work stations in accordance with the disclosed process.

2. Discussion of the Prior Art

U.S. Pat. No. 3,242,539 (Lubalin) discloses a metal casting process wherein patterns are adjacently positioned on a flat metal base plate. A contoured backing flask assembly, containing a pair of hingedly connected contour cavities dimensioned to fit over the pattern plate assembly, is then superposed over the patterns. Thus, a predetermined relatively thin open faced cavity exists between the interior surface of the backing flask cavities and the external surface of the patterns, which cavity corresponds to the desired thickness of the ceramic that will line the mold. A volatile alcohol or water-containing ceramic slurry is then poured into pouring apertures formed in the flask so that the cavity is filled. The rigid backing flask assembly and jelled ceramic is removed from the pattern and the flask and ceramic liner are fired to burn off volatiles and set the ceramic. After the flask is cooled, the hinged flask assembly is closed to define a lined mold cavity therebetween. The desired metal is then poured into the cavity.

The Lubalin process is not readily adapted to a quick and efficient continuous process, however, since the disclosed use of the ceramic slurry mandates that relatively long drying and firing steps be completed in order to properly set the ceramic. Further, use of a ceramic slurry often results in the formation of gas bubbles which, after firing, result in an uneven and sometimes cracked refractory lining causing poor overall casting quality. Also, the disclosed hinged flask assembly itself is heavy and quite expensive to handle and transport about the foundry.

Prior art U.S. Pat. No. 2,789,331 (Dietert) discloses another method of making molds for casting wherein a refractory lining is produced by blowing the refractory into the space provided between a pattern and a drying plate. After firing and cooling of the refractory, the hardened refractory is stripped from the pattern and drying plate assembly and then positioned adjacent a mating refractory to define a mold cavity therebetween. The mating refractories are inserted in a vice like mechanism so that they are firmly held together. Here again, the disclosed process cannot be effectively adapted to a quick continuous process because of the time consuming steps of stripping the refractory from its associated pattern and drying plate followed by combining mating refractories to the vice prior to pouring.

Other mold and casting formation processes are disclosed in U.S. Pat. Nos.:

| | |
|---|---|
| 2,837,798 | (Bleuenstein) |
| 2,940,140 | (Frantz) |
| 3,136,011 | (Peras) |

All of the above mentioned prior art patents are deficient with respect to the provision of a quick and continuous casting process wherein material handling costs are minimized. Further, in most of these prior art processes, large amounts of sand, sometimes on the order of one half to one ton sand per ton of resulting castings, must be used, thus necessitating utilization of expensive reclamation equipment. The prior art processes also require the use of heavy flask assemblies that are both burdensome and expensive to transport about the foundry.

These and other deficiencies of the prior art are overcome by use of the process disclaimed herein—which provides a relatively quick casting process that is ideally implemented in a continuous manner, with only minor interruptions between certain work stations being present. The equipment itself is relatively lightweight and can be readily transported about the foundry by movable hoists, wheeled assemblies, and the like. The process results in the formation of highly accurate castings with economies being realized in the areas of materials handling and equipment investment.

The foregoing and other advantages realized by the present process will become further apparent in the following detailed description, which is effectively amplified in the accompanying drawings.

DRAWINGS

In the drawings,

FIG. 1(*a*) is a perspective view of another completed mold assembly in accordance with the invention, with a horizontally extending sprue for pouring;

FIG. 3 is a top view of a backup plate and pattern portion with certain features thereof shown in phantom;

FIG. 4 is a side sectional view of the assembly shown in FIG. 3 with the backup plate and pattern portion assembly shown positioned under a blow head;

FIG. 5 is a partially cut-away perspective view showing the backup plate-pattern portion assembly after the refractory has been blown into the space along the backup plate-pattern interface;

DETAILED DESCRIPTION

The drawings have been prepared to illustrate the invention herein disclosed and should not be held to limit the scope of the invention, which is defined in the appended claims.

Figure 1:
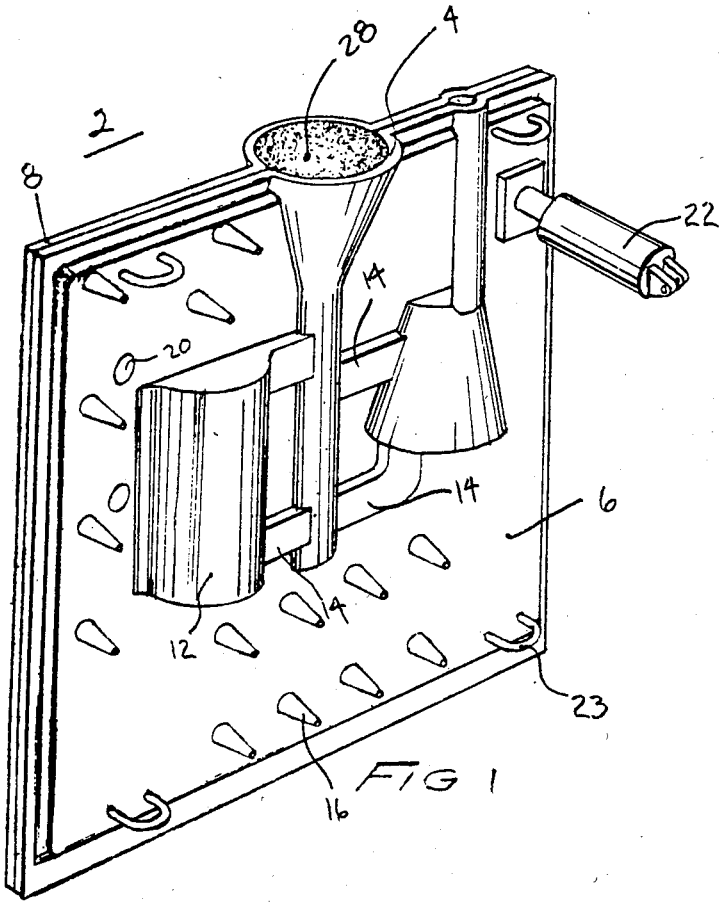
FIG. 1 is a perspective view of a completed mold assembly in accordance with the invention, with a vertically extending sprue for pouring.

Turning now to the drawings and specifically to FIGS. 1 and 1(*a*) thereof, there is shown a completed mold assembly 2 ready for pouring of the desired molten metal into sprue 4 which, as shown in FIG. 1, extends downwardly between the joint edges of the backup plates 6,8. It is an important feature of the invention that the sprue 4 may also extend through the side 10 of one of the backup plates remote from the joint edges of the plates (as shown in FIG. 1(*a*). This fact allows for versatility in the process since different types of core blowing machines may be readily accommodated.

The backup plates are suitably composed of aluminum, cast iron or steel, and the plates 6, 8 are formed so as to have portions 12 thereof that roughly correspond to the desired configuration of the casting. The plates 6, 8 may have a thickness of about $\frac{3}{8}$ inch and thus the entire assembly 2 is of relatively light weight when compared to prior art conventional flask and sand molds. This provides a distinct advantage over prior art processes since the entire assembly 2 can be more easily transported about the foundry.

The sprue 4 communicates with the portions 12 through channels 14 which have been formed in the plates 6, 8 via milling or torching.

The plates 6, 8 are preferably provided with cooling fins 16 which aid in even dissipation of the heat occasioned by pouring of the metal into the mold assembly.

Further, the backup plates 6, 8 are provided with vent holes 20 therein which also aid in heat dissipation and provide an escape for toxic gasses that may be used to bond the refractory. Further, after the desired casting has been cooled after pouring, the vents 20 provide a convenient location from which the casting can be easily "knocked out" of the mold 2.

The plates 6, 8 may be adjacently positioned by means of clamps 22 or the like. In practice, several clamps may be positioned about the plates 6, 8.

As shown, the plates 6, 8 are provided with transport hooks 23 that are adapted for easy attachment to moveable hoists or the like that may extend from the ceiling mounted from tracks supported by the foundry roof to facilitate automatic or manual transportation of the plates 6, 8 to the various work stations necessary in accordance with the process.

The plates 6, 8 can also be provided with trunions and wheels shafted thereon for easy transport about tracks that follow the process path around the foundry.

Male studs 24 (FIG. 4) and mating female apertures (not shown) may be provided on the respective plates 6, 8 so that the plates may be easily and properly aligned.

Figure 2:
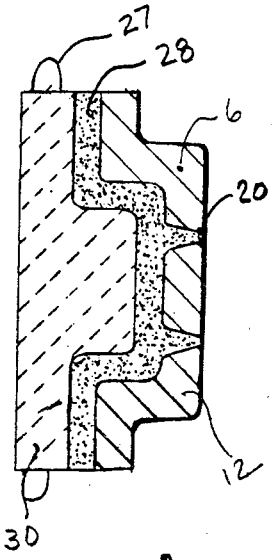
FIG. 2 is a side sectional view of a backup plate and pattern portion assembly showing the refractory lining interposed therebetween in accordance with the invention.
Figure 1A:
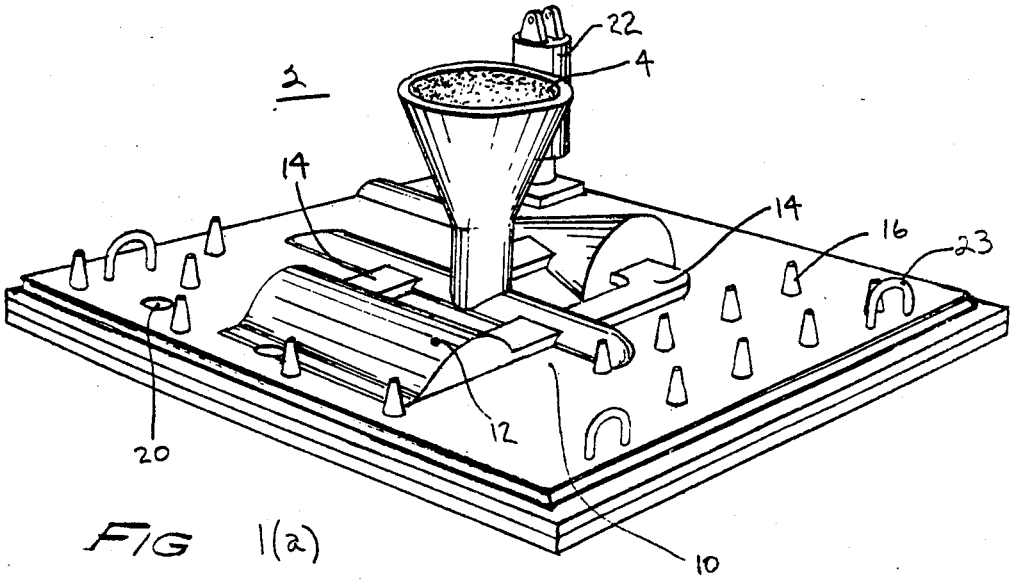

As shown in FIG. 2, interposed between plates 6, 8 is a thin layer of refractory 28 which is located in the mold 2 along the portions 12 of the plates 6, 8 corresponding to the desired configuration of the casting. In many cases, it will be desirable not to place any refractory whatsoever at points along the plates 6, 8 that are remotely located from the sprue 4 and communicating channels 14. The backup plates 6, 8 will then act as a chill at these points. This chilling action greatly enhances directional solidification, which, in turn, increases the yield and quality of the casting. To extend the life of the plates 6, 8, it is desirable to insert graphite pieces at these chill points. Graphite provides an excellent chill and will reduce the shock of the molten metal on the plates 6, 8, which shock may cause warping of the plates. The inclusion of graphite chill points also aids in even distribution of the heat throughout the plates 6, 8.

With reference now to FIGS. 2 through 5, there is shown backup plate 6 with pattern half 30 aligned therewith. The pattern half 30 may be composed of plastic or metal and it is also provided with hooks 27 (FIGS. 2, 4 and 5) or trunions and wheels shafted thereon for easy transportation about the process path. The refractory 28 lines the space extending along the pattern-plate interface in those space portions which correspond to the sprue 4, channels 14, and portions 12. The thickness of the refractory 28 may vary from about $\frac{1}{8}$ inch at the feather edge portions of the channels 14 and portions 12 to about 2 inches at the locations proximate the sprue 4. Once again, the provision of such a thin refractory layer 28 allows easy handling in contrast to prior art flask-sand molds. Further, since only relatively small amounts of the refractory are necessary, expensive reclamation equipment can be omitted from the process altogether—resulting in a considerable economic advantage.

Figure 6:
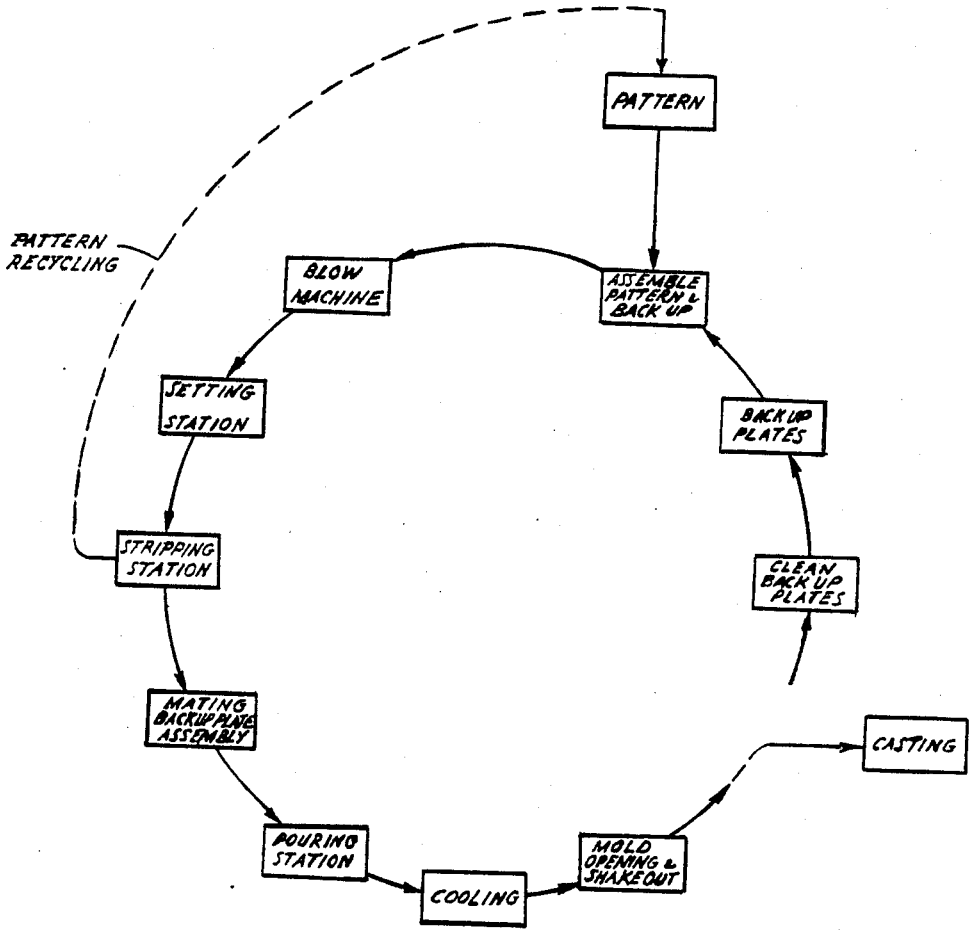
FIG. 6 is a flow diagram illustrating a suitable production layout for implementing the process herein disclosed.

Referring to FIG. 6 of the drawings, a typical production layout in accordance with the disclosed process is shown. For each desired casting, two pattern halves 30 and two mating backup plates 6, 8 are provided.

One pattern half 30 is aligned with one backup plate 6 or 8 at the assembly station. Suitable locator members are provided on the pattern 30 and backup plate 6 or 8 so that, in proper alignment, a thin space between the pattern half and the backup plate is formed in the portions 12 in which the casting will be formed.

The aligned pattern-backup plate assembly is then transported to a core blow mechanism. For this purpose, "FlexiBlomatic" machines manufactured by Beardsley and Piper Company, Chicago, Ill., are well suited. These machines are designed to blow refractory into the space along the pattern half-backup plate interface from either a vertically oriented or horizontally oriented blow head. A loading mechanism may be included in the production layout to load and unload the pattern-backup plate assembly from the core blow machine. Once again, the Beardsley and Piper Company provide suitable loading mechanisms for the disclosed core blowers.

Suitable refractories include silica sand, zircon sand, chromite sand, and olivine sand, and it is preferred to use a dry, bondable refractory.

The core blow mechanism may be loaded with an organic or inorganic binder and sand refractory mix. The equipment may be operated with thermosetting or cold-curing binders.

Suitable thermosetting phenolic resin binders may be used, as are currently employed in the so-called "shell molding" process.

Suitable "cold cure" resins include methylene disthenyl isocyanate. The latter resin is preferred and in the trade is known as "Cold Box-Isocure Resin" and is manufactured by Ashland Chemical Company.

Suitable "no-bake", organic, resin binders—such, as, those commercially available, i.e., alkyd resins, urea or phenolic formaldehyde resins, and urethane resins—may be used.

Suitable inorganic binders—such as, sodium silicate—will work very well. The binder may be gassed with $CO_2$ to produce a set, or powdered ferro silicon may be mixed with the sand, or other reagents may be used to produce a chemical set.

When cold-curing resins are utilized, a sharp saving in fuel cost is realized, and the time between blowing and setting of the resin is minimized with substantial improvement in productivity.

If a "cold-curing" resin binder is used, and such use is clearly preferred, the aligned pattern-backup plate assembly is transported to a setting station wherein the desired reactant or catalyst is injected into the refractory mix to cure the resin. When the catalyst is a gas, such as DMA, it is especially important that vent holes 20, properly located, be incorporated into the plates 6 and 8 so that the gas can diffuse over the entire refractory mix and escape through the backup plate.

The use of "Cold Box-Isocure Resin" is preferred, and when this resin is used, the methylene disthenyl isocyanate is first dissolved in an appropriate solvent, mixed with the refractory, and then blown into the space between the pattern and backup plate. This resin is cured at the setting station by gassing the refractory-resin mix with diethyl methyl amine (DMA) or other suitable tertiary amines.

If a thermosetting resin is used, the aligned pattern-backup plate assembly is set by heating to 600° F.

After the refactory lining has been set, the assembly is transported to a stripping station wherein the patterns are stripped from the backup plates 6, 8 with the refractory layer 28 lining the backup plates. Preferably, the pattern halves 30 have been treated with a suitable mold release agent such as, wax, or silicone spray coated on the pattern half 30 prior to alignment with one of the plates 6 or 8 so that the refractory will not adhere thereto.

After the patterns have been stripped, they are transported back to the assembly work station to be recycled back into the process.

After the stripping step, two lined, mating backup plates 6, 8 are joined by clamps or the like at the mating backup plate assembly station to define a lined, mold cavity.

The desired molten metal is then poured into the lined cavity, cooled, the plates opened, and the casting is then removed. The backup plates are then cleaned and transported to the assembly station to repeat their journey along the process path.

Although this invention has been described with reference to specific forms and embodiments thereof, which have been selected for illustration in the drawings, it will be appreciated that many aspects of the disclosure may be varied, without departing from the true spirit and scope of the invention. The appended claims are intended to cover all such equivalent aspects.

I claim:

1. A continuous method for making castings in a foundry comprising the steps of:

(a) providing a plurality of work stations and arranging them in substantially a closed circuit about said foundry to define a process path;

(b) providing first and second mating backup plates for each desired casting and connecting said first and second backup plates to transporting means for moving said first and second backup plates along said process path, each of said plates having a plurality of cooling fin members to aid in heat dissipation and hook means for connection to the transporting means.

(c) providing first and second mating pattern parts for each casting, transporting said first and second pattern parts to an assembly pattern and backup plate work station disposed along said process path;

(d) aligning said first pattern part with said first backup plate at said assembly pattern and backup plate work station so that a thin space between said first pattern part and said first backup plate is formed thereby, subsequently aligning said second pattern part with said second backup plate at said assembly pattern and backup plate work station so that a sprue and a thin space between said second part and said second backup plate is formed thereby, said sprue extending through the side of one of said second backup plates remote from the joint edges of the plates, and forming chill portions along said backup plates, and inserting secondary chill means along said chill portions;

(e) transporting said aligned first pattern part and said first backup plate to a blow work station disposed along said process path and blowing a bondable refractory material through said sprue into said thin space existing between said first pattern part and said first backup plate;

(f) transporting said aligned second pattern part and second backup plate to said blow work station and blowing said bondable refractory material into said thin space existing between said second pattern part and said second backup plate;

(g) causing said bondable refractory material to set whereby thin refractory linings are formed on said first and second backup plates and transporting said aligned first pattern part and said first backup plate along said process path to a stripping station, removing said first pattern part from said first backup plate at said stripping station, and subsequently directly transporting said first pattern part to said assembly pattern and backup plate work station without causing said first pattern part to stop at any other of said work stations;

(h) then transporting said aligned second pattern part and said second backup plate along said process path to said stripping work station, removing said second pattern part from said second backup plate at said stripping station, and subsequently directly transporting said second pattern part to said assembly pattern and backup plate work station without causing said second pattern part to stop at any other of said work stations;

(i) transporting said first and second backup plates to a mating backup plate assembly station disposed along said process path and superposing said first backup plate and said associated refractory lining on said second backup plate and its associated lining at said mating backup plate assembly station to define a lined mold cavity between said first and second backup plates;

(j) pouring a molten metal into said cavity;

(k) allowing said metal to cool;

(l) separating said first and second superposed backup plates; and (m) removing the casting from said cavity and transporting said first and second backup plates to said assembly pattern and backup plate work station so that the method may be repeated.

2. A method in accordance with claim 1 wherein said bondable, refractory material comprises a thermosetting resin binder and wherein said steps (e) and (f) comprises heating.

3. A method in accordance with claim 1 wherein said bondable refractory material comprises a chemically bondable resin and wherein said steps (e) and (f) comprises adding a chemical reactant to said refractory material to effect bonding thereof.

4. A method in accordance with claim 1 wherein said bondable refractory material comprises a catalytically bondable resin and wherein said steps (e) and (f) comprises adding a catalyst to said refractory material to effect bonding thereof.

5. A method in accordance with claim 4 wherein said reagent or catalyst comprises a gas.

6. A method in accordance with claim 5 wherein said gas is carbon dioxide.

7. A method in accordance with claim 5 wherein said gas comprises diethyl methyl amine.

8. A method in accordance with claim 1 wherein said steps (e) and (f) comprises blowing said bondable refractory material into said space to form a refractory layer having a thickness varying from about $\frac{1}{8}$ inch to about 2 inches.

9. A method in accordance with claim 1 wherein steel backup plates are provided.

10. A method in accordance with claim 1 wherein cast iron, steel, or aluminum backup plates are provided.

11. A method in accordance with claim 1 wherein said refractory comprises silica.

12. A method in accordance with claim 1 wherein said refractory comprises olivine.

13. A method in accordance with claim 1 wherein said refractory comprises chromite.

14. A method in accordance with claim 1 wherein said refractory comprises zircon.

15. The method according to claim 1 wherein said secondary chill means comprises graphite plates.

16. The method according to claim 1 wherein said backup plates include vent means.

* * * * *